United States Patent [19]

Wyckoff

[11] Patent Number: 4,681,401

[45] Date of Patent: Jul. 21, 1987

[54] SHEET MATERIAL MARKER SURFACE FOR ROADWAYS AND THE LIKE

[76] Inventor: Charles W. Wyckoff, 85 Pine St., Needham, Mass. 02192

[21] Appl. No.: 779,297

[22] Filed: Sep. 23, 1985

Related U.S. Application Data

[63] Continuation of Ser. No. 694,479, Jan. 23, 1985, abandoned, which is a continuation of Ser. No. 351,037, Feb. 22, 1982, abandoned.

[51] Int. Cl.[4] ..... G02B 5/124

[52] U.S. Cl. ..... 350/105

[58] Field of Search ..... 350/97, 103–106, 350/109; 404/9, 14; 428/143

[56] References Cited

U.S. PATENT DOCUMENTS

| | | | |
|---|---|---|---|
| 3,785,719 | 1/1974 | Jonnes | 350/105 |
| 3,920,346 | 11/1975 | Wyckoff | 404/14 |
| 3,954,324 | 5/1976 | Arnott et al. | 350/106 |
| 4,035,059 | 7/1977 | DeMaster | 350/105 |
| 4,040,760 | 8/1977 | Wyckoff | 404/14 |
| 4,069,787 | 1/1978 | Wyckoff | 116/63 |
| 4,145,112 | 3/0979 | Crone et al. | 350/103 |
| 4,182,548 | 1/1970 | Searight et al. | 350/103 |
| 4,236,788 | 12/1980 | Wyckoff | 350/97 |
| 4,279,471 | 7/1981 | Rowland | 350/103 |
| 4,388,359 | 6/1983 | Ethen et al. | 350/105 |

FOREIGN PATENT DOCUMENTS

| | | | |
|---|---|---|---|
| 1107799 | 3/1968 | United Kingdom | 350/105 |

*Primary Examiner*—John K. Corbin
*Assistant Examiner*—Loha Ben
*Attorney, Agent, or Firm*—Rines & Rines, Shapiro & Shapiro

[57] ABSTRACT

This disclosure involves an improved thin surface-marking strip for adhering to a road surface or the like, employing novel flattened somewhat saw-tooth wedges embodying retroreflective material and of preferably substantially trapezoidal shape, with rather critical separations between wedges relative to height and length of the wedges to obviate shadow effects, provide improved daylight observation, and to increase effectiveness and life, particularly under conditions of rain-covered surfaces and snow removal.

9 Claims, 2 Drawing Figures

SHEET MATERIAL MARKER SURFACE FOR ROADWAYS AND THE LIKE

CROSS-REFERENCE TO RELATED APPLICATIONS

This is a continuation application of U.S. Ser. No. 694,479 filed Jan. 23, 1985, which is a continuation application of U.S. Ser. No. 351,037 filed Feb. 22, 1982, both of which are now abandoned.

BACKGROUND OF THE INVENTION

The present invention relates to the distinctive marking of the directions of travel on motoring highways, airports and other surfaces, with the aid of thin marker strips adhered to the traveling or other surfaces and embodying successive spaced wedges provided with retroreflective materials; the invention being more particularly concerned with improved marker strips for such purposes.

Because of the extremely shallow angle that is made between an automobile headlamp and the roadway it illuminates, only a very small percentage of the light is reflected back for use by the motorist. The problem is made even more severe by the fact that the road surface is usually quite flat with poor reflection characteristics, black asphalt being the worst road surface from this viewpoint. Average road surface visibility with low beams for the automobile headlamps at night is usually restricted to about 100 feet. Considerable improvement is made by painting a white stripe on the road surface; but even this, with a freshly painted line, does not extend road surface visibility much beyond a couple of hundred feet. When the road surface is wet with rain, moreover, the visibility is drastically reduced even with a freshly painted line and does not extend more than a few tens of feet. The thin film of water which covers the road and paint surface acts like a mirror which reflects nearly all of the automobile headlamps' light away from the motorist. Thus, during rainy weather at night, even though provided with a good white stripe, the road appears almost pitch black to the motorist—this being the major reason why night driving in the rain is so treacherous.

The art has concluded that the only practical way to overcome this poor visibility is by means of raised pavement markers which literally extend above the thin film of water and retroreflect light back to the motorist. While commonly used in certain regions of the nation, especially in sunny climates, they are seldom used in the snow regions because of the destructive effects of snowplows. Efforts have been made to overcome this difficulty by designing a protective framework or ramp which literally guides the snowplow blade up and over the marker with little damage; but the general inability of some of these markers to withstand the harsh treatment given by the snowplows has prevented their widespread adoption. Such special constructions, furthermore, are expensive and are therefore usually positioned quite far apart. In addition they are useful only at night when illuminated by automobile headlamps and are poorly visible, if at all, by the motoring public during daylight hours, often requiring an additional or supplemental marker in the form of a painted line or a plastic line for daytime driving guidance.

The art has struggled for years, however, with a wide assortment of raised pavement markers, of one configuration or another, for the major purpose of guiding the night-driving motorist. The majority of these devices have little if any detectability or utility during daylight hours and are thus confined to night-time conditions wherein the illumination from automobile headlamps is redirected by means of internal reflection back upon itself, thereby to be observed by the operator of the vehicle. These devices often take the form of buttons or mounds containing retroreflecting elements or surfaces. More recently, ramp-like configurations have been adopted in order to provide less hazard to the vehicles traveling over them, some devices, indeed, having special ramps, previously mentioned, to assist in guiding the blades of snowplows, hopefully without uprooting them. Such devices, as before explained, are costly and, of necessity, must be relatively widely spaced from one another along the roadway surface, resulting in the disadvantage that, under headlamp illumination at night, although bright in appearance, these devices at best present only pinpoints of light and not a continuous and highly desirable solid line, nor even a semblance of a skip line. During daylight conditions they are usually not observable at all by the motoring public at any distance.

In an effort to overcome some of the above and other disadvantages of such and related raised pavement markers, markers of relatively low profile have been proposed, such as those disclosed in U.S. Pat. Nos. 3,785,719, 4,035,059 and 4,279,471. These concepts, however, involved individual units which are still costly to manufacture and thus again must be used with relatively wide spacing between units to achieve realistic operational and cost effectiveness.

A more suitable approach for obviating these problems has resided in the use of thin flexible sheeting on which is contained a series of very low profile raised pavement markers as described, for example, in my earlier U.S. Pat. Nos. 3,920,346; 4,040,760; and 4,069,787; and in U.S. Pat. Nos. 4,145,112; 4,182,548; and 4,236,788. With the exception of the constructions of my said U.S. Pat. Nos. 4,040,760 and 4,069,787, such sheet markers are dependent upon having the main body of the marker constructed so as to be transparent to light, rendering the devices subject to serious light loss effects in use, caused by abrasion and accumulated dirt. In my said earlier constructions, embodying the use of somewhat saw-tooth successive wedges carried by a thin road-attachable strip, while quite satisfactory operation can be attained, it has been found that shadow effects when heading into the sun, and modification of results after the wedges have experienced some wear, as from extended use and/or snowplow defacement or the like, do not permit as effective marking in daylight, dusk or under other adverse conditions as may be desirable.

In the case of the successive wedges of substantially triangular shape taught in my said U.S. Pat. No. 4,040,760, for example, extended use revealed that under certain conditions of ambient daylight, the pavement marker became somewhat difficult for the motorist to observe. In particular, if the marker strip is oriented in such a way that the motorist is heading in the general direction of the sun on a cloudless day, the contrast between the marker and the road surface is so low that the marker becomes difficult to distinguish. During these conditions, the sun will cast a shadow of each wedge on the valley floor between the wedges. Those faces of the wedges observed by the motorist, furthermore, are all contained within the shadow and thus appear black, introducing great difficulty in distinguishing the marker from the dark road surface. The appearance of blackness or the poor contrast between the marker and the road surface is at a peak when the sun is at a low angle on a cloudless day.

SUMMARY OF THE INVENTION

It was fortuitously discovered that by changing the saw-tooth shape from triangular to trapezoidal, but only with appropriate wedge length to successive wedge spacing, the foregoing problem was completely obviated, and simultaneous other marked advantages in greater wear-resistance and life under abrasion, including snowplowing, also followed. The flat tops of the now trapezoidal-shaped wedge, if of appropriate dimensions and spacing, reflect sunlight and reduce the wedge shadow effect admirably well.

An object of the present invention, accordingly, is to provide a new and improved marker structure that shall not be subject to the above and other disadvantages, but that can obviate shadow and discontinuous effects and provides a marked improvement in wear and use under adverse environmental conditions.

An additional object of the invention is to provide a flexible sheet material pavement marker or the like which will be clearly visible as a continuous line by ambient daylight as well as retroreflection from automobile headlamps at night, even during a heavy downpour of rain.

A further object is to provide a flexible sheet material pavement marker with a configuration and low profile sufficient to resist uprooting by normal snowplow action.

Still another object is to provide a highly visible highway marker for night driving with a long life and with good retroreflection characteristics maintained throughout such life.

A further object is to provide a novel marker of more general utility, as well.

Other and further objects are explained hereinafter and are more particularly pointed out in the appended claims.

In summary, however, the invention, from one of its aspects, contemplates in combination with a roadway surface and the like, a direction-indicating surface marker strip of pre-formed flexible plastic material adherable to said surface by a thin layer of adhesive between the strip and said surface, said strip being intermittently deformed upward to provide successive transversely disposed wedges of substantially trapezoidal shape in longitudinal section, each wedge having a substantially flat top surface bounded by upwardly and downwardly acute-angle inclining front and rear surfaces, said inclining surfaces being provided with embedded retroreflecting beads, and the flat top surface width being comparable to the width of the valley surfaces in the strip between successive wedges. Preferred details of construction and best mode embodiments are later set forth.

BRIEF DESCRIPTION OF THE DRAWINGS

The invention will now be described with reference to the accompanying drawing.

DETAILED DESCRIPTION OF PREFERRED EMBODIMENTS

Figure 1:
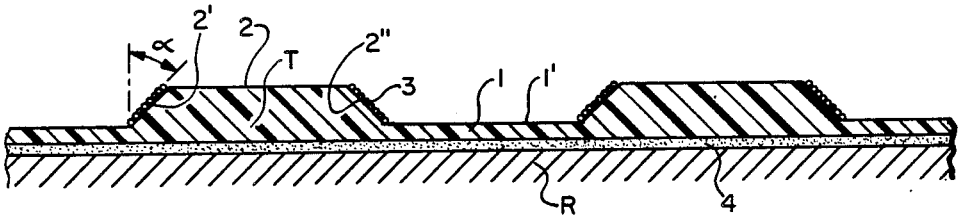
FIG. 1 of which is a longitudinal sectional view of a preferred embodiment of the invention.

Referring to FIG. 1, the thin flexible plastic elongated road marker strip 1 is shown adhered by a bottom adhesive layer 4 to the roadway or other surface R. Suitable materials are described in my said earlier patents and are hereinafter discussed. As previously described, the somewhat saw-tooth wedge construction is illustrated in the form of substantially trapezoidal (in longitudinal section) wedge projections T having a flat top surface 2 and bounded by upwardly and downwardly inclining front and rear ridge surfaces 2' and 2'', all extending transversely across the strip 1, and all preferably integrally formed from the thin plastic material of the strip 1, with the wedges intermittently deformed upward of the strip.

A preferred range of acute angles $\alpha$ of inclination (or downward slope) enable proper operation in use as hereinafter discussed. At least the upwardly and downwardly inclined surfaces 2' and 2'' carry a retroreflective bead layer(s) 3.

With this construction, it has been discovered that, instead of observing an apparent extension of a portion of one wedge face continuously merging with the next succeeding wedge face portion and so on, as described in my earlier patents, in the case of the trapezoidal wedge of FIG. 1, there is an interruption in the apparent merging wedge faces by the width of the flat top surface 2 of the trapezoidal wedge T. Considering daylight operation, including heading into the sun, when this diffusely reflecting flat top surface 2 has the same apparent area as that observable portion of the wedge face which is in shadow, it has been found that the visual effect of the sun shadow becomes sufficiently reduced to permit the marker 1 to be readily visually distinguished from the road surface R. This provides marker indication under such daylight or dusk considerations that previous constructions do not adequately provide. Increasing the area would provide even better daylight contrast between the marker and the road surface, but the apparent brightness of night time retroreflection from automobile headlamps would diminish. The condition for producing apparent equal areas is fulfilled when the width of the flat top surface 2 of the trapezoidal wedge T is made about equal (comparable) to that of the valley floor 1' between successive wedges. It has also been determined that, for the purposes of the invention, the height of the wedges is preferably a small fraction of the wedge width (longitudinally); preferably of the order of 1/6 or so.

Tests have shown the effectiveness of such a construction for supplementing night-time retroreflection with adequate daylight marker observation even under shadowing conditions, for the marker strip of FIG. 1 of the following specifications:

| | |
|---|---|
| Flat top surface (2) width | 300 mils |
| Valley floor (1') width | 300 mils |
| Ridge height (vertical height of 2', 2'') | 50 mils |
| Angle $\alpha$ | Substantially 0–45° |
| Glass beads (3) | 5–10 mils diameter (n = 1.9) |

When observed from a light source directed at an angle of about 85° from the normal, the light return by retroreflection from surfaces 2' or 2'' was excellent. As placed on a pavement surface R and observed late in the afternoon on a cloudless sunny day, with the marker strip 1 oriented so that heavy shadows of the ridges 2', 2'' were formed on the valley floors 1' between the same, viewing at angles of 45° to 85° from the normal in the general direction of the sun, demonstrated that the marker appeared clearly light in tone against the dark road surface. In night time retroreflection, it has been determined that a motorists at 1200 feet distance should be able to view the top row of 10 mils beads on the wedge ridges.

Figure 2:
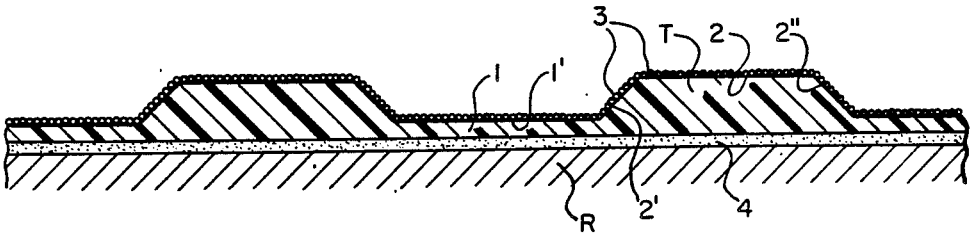
FIG. 2 is a similar view of a modification.

In FIG. 2, the provision of retroreflection beads 3 is shown over all surfaces of the marker strip 1.

A satisfactory technique for fabricating the specially configured marker strips of the invention involves the use of a mold machined out of, for example, an aluminum block, say 4 inches wide and ½ inch thick. The grooves for the samples above described were 300 mils wide at the tops (corresponding to marker top surfaces 2) with 30° sloping sides (corresponding to 2', 2''), 50 mils deep. Each groove was spaced 600 mils apart. Narrow strips of 5 mil-thick polyethelene were secured to the sloping walls of the mold grooves with a suitable heat-resistant adhesive 4. The mold was heated to about 280° F. and glass microspheres 3 (10 mils diameter, with a refractive index n of about 1.9) were poured into the grooves and pressed into the softened polyethelene. After cooling the mold, the excess microspheres were removed so that the only ones remaining were those immersed to approximately 40% of their diameters in the polyethelene. Next, a plastisol of PVC containing a white pigment was added to fill the grooves of the mold and cover the top side to a depth of about 15 mils. This was placed in a heated oven for sufficient time to ensure bringing the plastisol to a temperature of about 330° F. in order to fuse and solidify the casting. When cooled, the PVC casting was stripped from the mold with the microspheres now securely anchored to about 60% of their diameters in the sloping sides of the ridge or wedge walls of the PVC casting.

Further modifications will suggest themselves in the light of the above to those skilled in this art, and such are considered to fall within the spirit and scope of the invention as defined in the appended claims.

What is claimed is:

1. In combination with a roadway surface and the like, a direction-indicating surface marker strip comprising plastic material secured to said surface, said strip being intermittently deformed upward to provide successive wedges of substantially trapezoidal shape in longitudinal vertical section, each wedge having a top surface bounded by inclined front and rear surfaces, the height of each wedge being small relative to the longitudinal dimension of the top surface of the wedge, each of said inclined surfaces being provided with a surface layer of retroreflecting beads, said layer of retroreflecting beads having at least a top row thereof which is visible at night to a motorist hundreds of feet away by retroreflection of vehicle headlights, the configuration, dimensions, and spacing of the wedges being selected to reduce substantially the obscuring of the marker strip by shadows of the wedges in sunlight, so that the marker strip is clearly visible to a motorist during the day as well as at night, and whereby the marker strip has a long effective life even when subjected to abrasion and dirt.

2. A direction-indicating surface marker strip in accordance with claim 1, wherein the top surface of each wedge has a substantially horizontal area that is substantially greater than the area of each inclined surface.

3. A direction-indicating surface marker strip in accordance with claim 1, wherein successive wedges of said strip are separated by a substantially horizontal surface having an area that is substantially greater than that of each inclined surface.

4. A direction-indicating surface marker strip in accordance with claim 1, wherein each inclined surface forms an angle with respect to vertical that is substantially within the range of 0 degree to 45 degrees.

5. A direction-indicating surface marker strip in accordance with claim 1, wherein the height of each wedge is a small fraction of the longitudinal dimension of the top surface of the wedge.

6. A direction-indicating surface marker strip in accordance with claim 5, wherein the longitudinal dimension of said top surface is of the order of a few hundred mils and said fraction is of the order of 1/6.

7. A direction-indicating surface marker strip in accordance with claim 1, wherein all of the top and inclined surfaces of said wedges are provided with retroreflecting beads, as well as surfaces of said strip between successive wedges.

8. A direction-indicating surface marker strip in accordance with claim 1, wherein said beads are about 60 percent embedded in the strip material.

9. For use with a roadway surface and the like, a direction-indicating surface marker strip comprising plastic material adapted to be secured to said roadway surface, said strip being intermittently deformed upward to provide successive wedges of substantially trapezoidal shape in longitudinal vertical section, each wedge having a top surface bounded by inclined front and rear surfaces, each top surface having a substantially horizontal surface area that is substantially greater than the area of each inclined surface, successive wedges of said strip being separated by substantially horizontal surfaces each having an area substantially greater than that of each inclined surface, each inclined surface forming an angle with respect to vertical that is substantially within the range of 0 degree to 45 degrees, the height of each wedge being a small fraction of the longitudinal dimension of the top surface of the wedge, each of said inclined surfaces being provided with a surface layer of retroreflecting beads, said layer of retroreflective beads having at least a top row thereof which is visible at night to a motorist hundreds of feet away by retroreflection of vehicle headlights, the configuration, dimensions, and spacing of the wedges being selected to reduce substantially the obscuring of the marker strip by shadows of the wedges in sunlight, so that the marker strip is clearly visible to a motorist during the day as well as at night, and whereby the marker strip has a long effective life even when subjected to abrasion and dirt.

* * * * *